United States Patent [19]

Breslow et al.

[11] Patent Number: 4,484,747

[45] Date of Patent: Nov. 27, 1984

[54] BOARD GAME WITH PLAYING PIECE DISPENSER

[75] Inventors: Jeffrey D. Breslow, Highland Park; John V. Zaruba, Chicago; Donald A. Rosenwinkel, Tinley Park, all of Ill.

[73] Assignee: Marvin Glass & Associates, Chicago, Ill.

[21] Appl. No.: 424,354

[22] Filed: Sep. 27, 1982

[51] Int. Cl.[3] ..... A63F 3/00

[52] U.S. Cl. ..... 273/243; 273/289; 273/249; 221/196; 221/301

[58] Field of Search ..... 273/201, 243, 248, 249, 273/287, 144 A; 221/194, 196, 298, 301, 291

[56] References Cited

U.S. PATENT DOCUMENTS

| | | | |
|---|---|---|---|
| 737,736 | 9/1903 | Harmon | 221/196 X |
| 1,606,883 | 11/1926 | McCrory et al. | 221/298 X |
| 1,778,952 | 10/1930 | McCullough | 221/301 |
| 2,285,342 | 6/1942 | MacLellan | 273/201 |
| 2,889,961 | 6/1959 | Belmonte | 273/148 R X |
| 3,000,538 | 9/1961 | Haller | 221/298 X |
| 3,436,080 | 4/1969 | Schultz | 273/287 |
| 3,592,472 | 7/1971 | Kent | 273/241 |
| 3,612,527 | 10/1971 | Rogerson | 273/258 X |
| 4,029,320 | 6/1977 | Hausman | 273/249 |
| 4,128,246 | 12/1978 | Hicks et al. | 273/243 |
| 4,290,608 | 9/1981 | Brown | 273/256 |

OTHER PUBLICATIONS

"Donkey Kong", Playmeter Magazine, Nov. 15, 1981, pp. 47, 48.

*Primary Examiner*—Richard C. Pinkham
*Assistant Examiner*—Scott L. Brown

[57] ABSTRACT

A board game includes a game board with a plurality of playing positions arranged thereon. A first set of playing pieces, conveniently in the form of construction workers, are moved along the playing positions while other sets of playing pieces, conveniently in the form of barrels and fire balls, interfere with the progress of the first set of playing pieces. Conflicts between the first and second sets of playing pieces are resolved by a two suit deck of cards. A playing piece dispenser is arranged to dispense playing pieces of the first set, one at a time directly onto the playing surface. The playing piece dispenser includes a collection bin for storing a plurality of playing pieces in serial fashion. A pivotal arm is connected at an outlet opening of the bin to receive a single playing piece therein. The pivotal arm receives a playing piece when the arm is in a generally horizontal position. In response to downward pivotal movement instituted by the user, the playing piece slides through the pivotal arm to a position just over the playing surface so that the playing piece may be accurately deposited on the game board.

16 Claims, 3 Drawing Figures

10
12
14
16
18
20
20a
20f
22
24
26
28
30
32
34
36
36a
36b
38
40
42
44
46
48
50
63
76
78
79
JUMP 200
HAMMER 400

3
14
26
46
48
50
52
54
56
58
60
62
64
66
67
80
82
83
84
86

A
12
26
46
50
58
60
62
63
64
66
67
68
70
72
83

BOARD GAME WITH PLAYING PIECE DISPENSER

BACKGROUND OF THE INVENTION

1. Field of the Invention

This invention relates generally to board game devices and in one important aspect of the present invention to devices for dispensing playing pieces.

2. Background Art

Board games using toys to implement the board games are not unknown in the art. The combination of a board game and a toy which plays an important role in implementing the game is capable of considerable entertainment potential both as a toy and as a board game.

Currently electronic video games are enjoying a great deal of entertainment attention. These games are capable of highly realistic visual and audio effects and therefore have enjoyed considerable success. In one such video game, marketed under the name "Donkey Kong", a simian image carries a helpless young lady image up a video steel girder building. The player controls a hero image which also moves up the building from girder to girder in pursuit. The simian image propels barrels downwardly at the player's hero, which must avoid the falling barrels. The barrels may be either jumped or fended off with hammers.

While the DONKEY KONG video game has enjoyed considerable success, it also entails concomitant expense for its players. While the potential enjoyment certainly is considered a worthwhile investment for many players, it would be desirable to provide a game of this type in a less expensive format while presenting unique challenges and interplay not possible with video games.

SUMMARY OF THE INVENTION

The primary object of the present invention is to provide a highly enjoyable board game and to provide as well an entertaining playing piece dispensing toy for use in conjunction with such a board game.

It is also an object of the present invention to provide a board game capable of entertaining action, comparable to that enjoyed by many video games.

These and other objects of the present invention are achieved by a board game including a game board defining a plurality of connected playing positions. The first and second sets of playing pieces are moved across the game board in accordance with a chance selection device for governing their movement. Means are provided for resolving the simultaneous joint occupancy of the same playing position by playing pieces of the first and second sets. The means include a deck of cards, the cards bearing indicia indicating a point accumulation and the resolution of the joint occupancy of the playing position.

In accordance with another important aspect of the present invention a playing piece dispenser for a board game includes a housing and a gravity feeding playing piece storage bin contained within the housing. The bin includes a filling opening and a dispensing opening. A pivotal arm conveys a playing piece from the storage bin onto the supporting surface. The arm is arranged to receive playing pieces one at a time through the dispensing opening and to hold each playing piece until the arm is pivoted toward the supporting surface.

DETAILED DESCRIPTION OF THE PREFERRED EMBODIMENT

Figure 1:
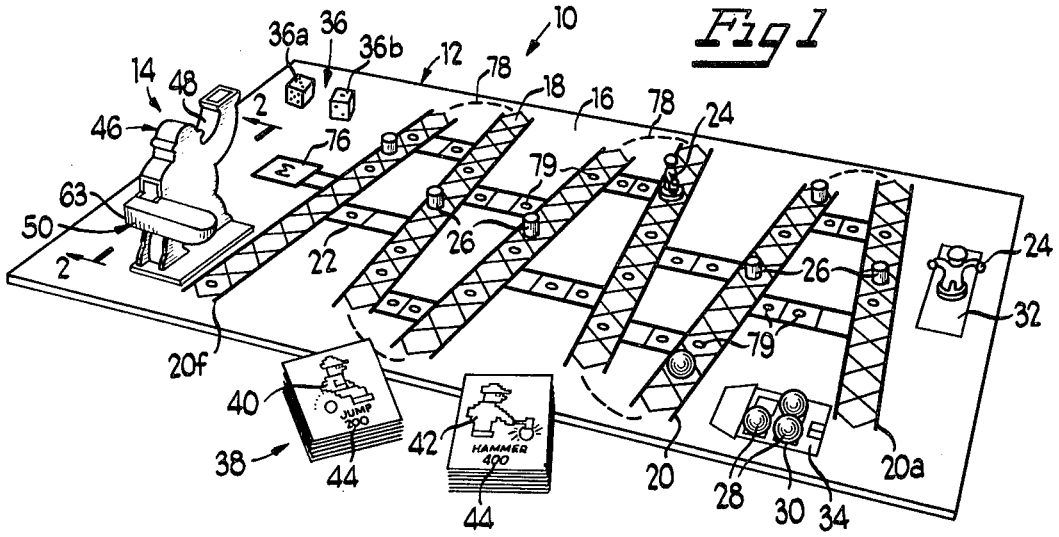
FIG. 1 is a perspective view of one embodiment of the present invention in the course of play.

Referring to the drawing wherein like reference characters are used for like parts throughout the several views, a board game 10, shown in FIG. 1, includes a game board 12 and a playing piece dispenser 14. In a conventional fashion the game board 12 defines a playing surface 16 with a plurality of playing positions 18 indicated thereon. In the embodiment illustrated, the playing positions 18 are defined by indicia 20 in the form of canted but broadly horizontal girder beams or floors divided into playing positions and indicia 22 in the form of generally vertical ladders interconnecting the generally horizontal beams and also defining playing positions.

Also included with the board game 10 are three sets of playing pieces 24, 26, and 28. The first set of playing pieces 24 are conveniently in the form of "construction workers", the second set of playing pieces 26 are conveniently in the form of "barrels" and the third set of playing pieces 28 are conveniently in the form of "fire balls". The playing pieces 28 are generally spherical with a flat surface 30 for controlling their position on the game board 12. When not in play the first set of playing pieces 24 are collected on a space 32 near the lower portion of the board 12 and the third set of playing pieces 28 are collected atop the indicia 34 conveniently in the shape of a house. As will be described hereinafter, the second set of playing pieces are stored within the playing piece dispenser 14 when not in play.

A chance selection device 36, conveniently a pair of distinctly colored dice, is included for controlling the movement of the various playing pieces on the game board 12. Advantageously one die **36*a* controls the movement of the first set of playing pieces 24 while the other die 36*b*** controls the movement of the other playing pieces.

A deck of cards is provided for resolving situations where the same playing position 18 is occupied by a playing piece of the first set 24 and the second or third sets 26 or 28 respectively. The deck of cards 38 includes one suit with card indicia 40 indicating a barrel being jumped and and another suit bearing indicia 42 representing a barrel being hammered. Each of the playing cards 38 bearing the indicia 40 or 42 also bear indicia 44 indicating a score accrued upon playing of the card 38.

Figure 2:
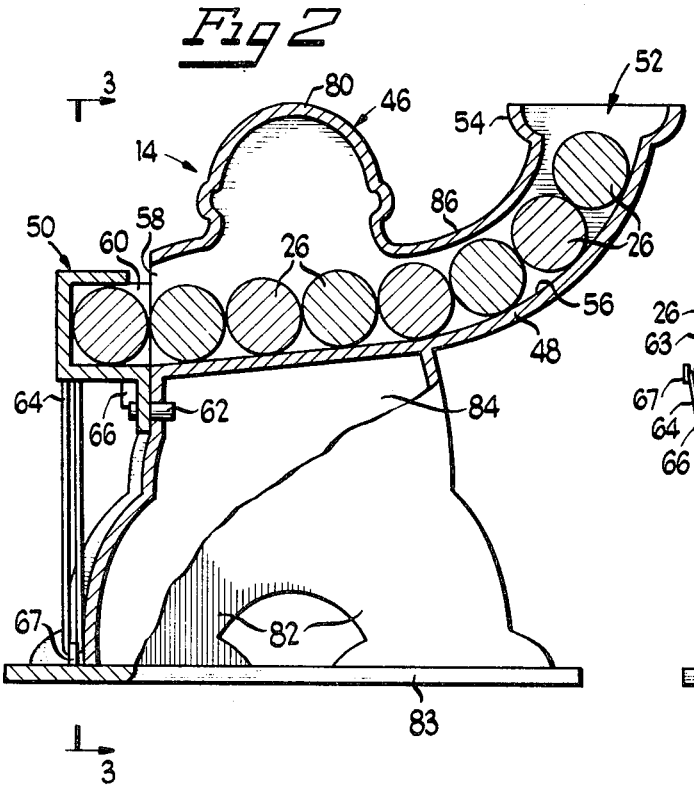
FIG. 2 is an enlarged cross-sectional view taken generally along the line 2—2 in FIG. 1.
Figure 3:
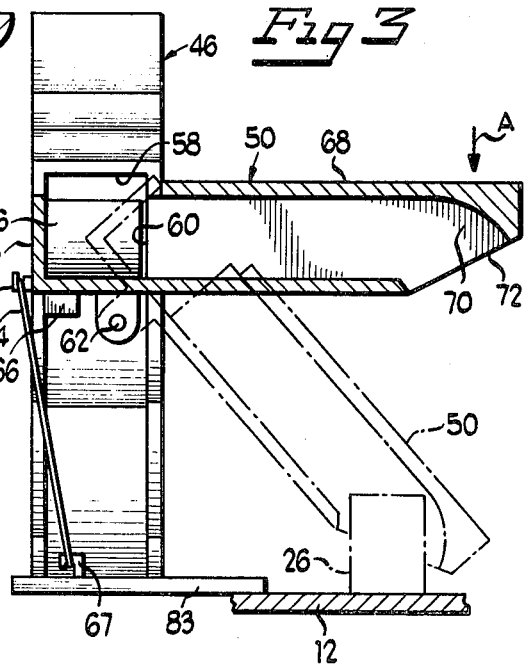
FIG. 3 is a cross-sectional view taken generally along the line 3—3 in FIG. 2.

As shown in FIGS. 2 and 3, the playing piece dispenser 14 includes a housing 46, a playing piece collection bin 48 and a pivotal arm 50. Advantageously the housing 46 is of a simian, humanoid or animate shape with a head 80, legs 82, a base 83, a torso 84 and arms 86 and 50.

The barrel shaped playing pieces of the second set of playing pieces 26 are loaded, on their sides, one at a time into the loading opening 52 located near the top of the bin 48 defined in one apparently uplifted arm 86. The loading opening 52 conveniently has a flanged peripheral edge 54 to facilitate the collection of a playing pieces therein. The interior of the bin 48 is sized to receive the barrel shaped playing pieces of the second set 26 on their sides in a side by side serial array, as shown in FIG. 2. In this arrangement the barrel shaped playing pieces 26 tend to gravity feed, due to the inclined surface 56 of the bin 48, toward an exit opening 58. The exit opening 58 is aligned with an opening 60 in the generally hollow pivotal arm 50 which is arranged normally in a generally horizontal position extending transversely to the housing 46 and bin 48, as shown in FIG. 3.

The pivotal arm 50 is mounted for pivotal movement on a pin 62, spaced from the upper end 63 of the arm 50. However, the pivotal movement of the arm 50 is controlled by a resilient band 64 and a stop 66. The stop 66 prevents upward tilting of the open free end 68 of the arm 50 by limiting the movement of the end 63. The band 64, stretched between a catch 67 at the end 63 of the arm 50 and a catch 67 on the housing 46, resists, but does not prevent, downward pivotal motion of the free end 68 towards the game board 12.

The interior of the arm 50 is sized to receive and conform to a barrel shaped playing piece 26 on its side; however, the length of the interior of the arm 50 is aligned generally with the length of the barrel shaped playing piece received from the bin 48. The interior of the arm 50 curves in the region 70 of the free end 68 so that a barrel shaped playing piece 26, sliding downwardly through the arm 50 when the arm is in the downward position illustrated in dotted lines in FIG. 3, is positioned upright on the game board 12. The repositioning of the playing piece 26 is effected by the curved region 70 due to the angled nature of the opening 72 at the free end 68 with respect to the remainder of the arm 50.

To utilize the dispenser 14 a number of playing pieces 26 are loaded through the opening 52 on their sides until the bin 48 is filled. The bin 48, within the animate or humanoid arm 86, gravity feeds the playing pieces 26 to the pivotal arm 50, also in the form of an animate or humanoid arm, one at a time. The pivotal arm 50 in turn receives a single playing piece 26 from the bin 48 when the arm is in its generally horizontal position. This is because the interior of the arm 50 is sized to receive only one playing piece 26 at a time, when the playing pieces are fed transversely into the arm 50. Since the arm 50 is in a horizontal position there is no incentive for the playing piece 26 just received into the arm 50 to move from its stable position, and as a result no additional playing pieces are able to enter the arm 50. However, when the user deflects the arm 50 downwardly, as indicated by the arrow A in FIG. 3, the playing piece 26 located therein is inclined and slides downwardly. The piece 26 is rotated by the curved region 70 and the opening 72, coming to rest in an upright position on the game board 12.

When the arm 50 is released it automatically returns to its original position under the action of the band 64 and the stop 66. While the arm 50 is in its downwardly deflected position no playing pieces 26 may be fed into the arm 50 because the position of the arm 50 and particularly its end 63, interferes with the gravity feeding of the playing pieces 26. However, when the arm 50 returns to its horizontal position a new playing piece 26 is automatically fed into the vacant position within the arm 50.

In this way the dispenser 14 has the appearance of a creature placing the playing pieces on the game board 12. The playing pieces appear to be transferred from one of the creature's arms to the other and then set down on the game board.

During the play of the board game 10, two or more players progress their playing pieces 24 from a lower position represented by the beam indicia **20*a* to an upper position represented by the beam indicia 20*f*. More particularly the players attempt to move at least one playing piece 24 into the finish position 76. During each turn or move of each player, an additional playing piece of the second set 26 is dispensed by the player from the playing piece dispenser 14 onto a playing position 18 along the beam indicia 20*f*. The playing pieces of the second set 26 move from the upper end of the board 12 represented by the beam indicia 20*f* towards the lower beam indicia 20*a*. In accordance with one method of playing the present game, the playing pieces of the second set 26 are converted into playing pieces of the third set 28 when they reach the lowermost beam indicia 20*a*. The playing pieces of the third set 28 then move in the opposite direction, upwardly towards the beam indicia 20*f*. The playing pieces of the second set 26 may move off the end of a beam 20, following the pattern indicated by dotted line indicia 78, "falling" onto a lower beam 20**.

To play the game each player positions his or her playing piece 24 at a position along the lowermost beam indicia **20*a*. In addition a plurality of playing pieces of the second set 26 are positioned across the game board 12 in the positions shown in FIG. 1. Initially the playing pieces of the third set 28 are not located on the playing positions 18, but instead are all located on the house indicia 34. The players are each dealt three cards face down from the shuffled deck 38**.

Each player, in turn, rolls the dice 36 to indicate the number of moves to be undertaken by that player's playing piece 24 and the playing pieces of the second set 26 and third set 28. Generally it is preferred that the player move the playing pieces 24 first, then the playing pieces of the third set 28, and finally playing pieces of the second set 26. A number of colored dots 79 are positioned at spaced locations across the game board on different playing positions 18 and when a player's piece 24 lands thereon the player is entitled to an additional card 38.

Points are scored when a player's playing piece 24 occupies the same position occupied by a playing piece of the second set 26 or third set 28. When this occurs, a player must play one of the cards 38 bearing the indicia 40 or 42. If a card with the indicia 40 is played the player jumps his or her playing piece 24 over the position occupied by the playing piece 26 or 28 and occupies the next space. If the player plays a card bearing indicia 42, the playing piece 26 or 28 is eliminated and the player's playing piece 26 solely occupies the position formerly occupied by the playing piece 26 or 28. In any case the player is entitled to keep the card 38 played and accrues a score in accordance with the indicia 44 on the particular card 38 played. Playing pieces of the third set 28 destroy playing pieces of the second set 26 when they are located on the same playing position 18.

If during the play of the game a player has used all of his or her cards 38, the player continues to play as before unless a playing piece of the second or third sets interferes with the player's continued play. Then the player must lose his or her turn except that the player must still move the playing pieces of the second set 26 and third set 28 as before. In addition if any playing pieces of the second set 26 or third set 28 land upon the position occupied by the player's playing piece 24, the player must randomly pick one of his or her collected, already played cards 38 and return it to the deck. In a related maneuver a player may steal cards from a depleted opponent who has no more playing cards 38 which have not been played, by moving a playing piece of the second set 26 onto the playing position 18 occupied by the depleted opponents's playing piece 24. The player then is entitled to one of the depleted opponent's already played cards 38.

The winner of the game is the player who has scored the most points. Bonus points are awarded to the first player to occupy the position 76. Conveniently play immediately ceases when any player has progressed to the position 76.

The board game 10 is capable of implementing a highly enjoyable game that enacts a scenario comparable to that involved in the video game known as "Donkey Kong". In particular the entertainment value of the game 10 can be enhanced by making the playing pices 24, 26, and 28, the game board indicia 20 and 22, and the dispenser 14 visually comparable to the images associated with the "Donkey Kong" video game. However, the present invention is capable of implementing a board game and a playing dispenser useful in implementing games having a variety of themes, and, through its structural arrangement, achieving uniquely enjoyable interplay.

Many modifications and variations of the present invention are possible in light of the above teaching. Thus, it is to be understood that within the scope of the appended claims, the invention may be practiced otherwise than as specifically described above.

What is claimed and desired to be secured by Letters Patent of the United States is:

1. A board game comprising:

a game board defining a plurality of associated playing positions;

a first set of playing pieces;

a second set of playing pieces;

a chance selection device for governing the movement of said first and second sets of playing pieces from one playing position to another;

means for resolving the simultaneous joint occupation of the same position by playing pieces of the first and second sets, said means including a deck of cards, said cards bearing indicia indicating a point accumulation and resolution of the joint occupancy of said playing position; and a dispensing means for dispensing playing pieces received in one orientation onto said game board in a different orientation.

2. The board game of claim 1 including a third set of playing pieces.

3. The board game of claim 2 wherein said first set of playing pieces are of humanoid form and said second set of playing pieces have the appearance of barrels.

4. The board game of claim 1 including indicia in the form of a plurality of floors connected by ladders, said floor and ladder indicia defining playing positions.

5. The board game of claim 1 wherein said chance selection device includes a pair of dice.

6. The board game of claim 1 wherein said deck of cards includes two distinguishable suits of cards, one of said suits bearing hammer indicia, and the other of said suits bearing jumping indicia.

7. The board game of claim 1 wherein said dispensing means includes a housing, a gravity feeding collection bin defined within said housing and means for dispensing said playing pieces one at a time.

8. The board game of claim 7 wherein said housing has an animate form, said bin being in the shape of an animate arm and said dispensing means including a pivotal member in the shape of another arm.

9. A board game comprising:

a game board defining a plurality of associated playing positions;

a first set of playing pieces;

a second set of playing pieces;

a chance selection device for governing the movement of said first and second sets of playing pieces from one playing position to another;

means for resolving the simultaneous joint occupation of the same position by playing pieces of the first and second sets, said means including a deck of cards, said cards bearing indicia indicating a point accumulation and a resolution of the joint occupancy of said playing position;

a dispensing means including a housing, a gravity feeding collection bin defined within said housing and means for dispensing said playing pieces onto said game board one at a time; and said one at a time dispening means including a pivotal arm extendable from said bin to said game board, said arm arranged to receive a playing piece from said bin and to deposit it on the game board.

10. The board game of claim 9 wherein said pivotal arm pivots between a generally horizontal position and a downwardly canted position with its free end adjacent the game board, said arm including means for returning the arm to its generally horizontal position after deflection to its downwardly canted position.

11. The board game of claim 10 wherein said pivotal arm is arranged generally transversely to said bin.

12. The board game of claim 9 wherein said housing has an animate form, said bin being in the form of an uplifted animate arm and said pivotal arm also being in the form of an animate arm, such that the housing operates to give the appearance of a figure positioning the playing pieces on a playing surface.

13. The board game of claim 9 including a third set of playing pieces.

14. The board game of claim 13 wherein said first set of playing pieces are of humanoid form and said second set of playing pieces have the appearance of barrels.

15. The board game of claim 9 including indicia in the form of a plurality of floors connected by ladders, said floor and ladder indicia defining playing positions.

16. The board game of claim 9 wherein said deck of cards includes two distinguishable suits of cards, one of said suits bearing hammer indicia, and the other of said suits bearing jumping indicia.

* * * * *